US006000193A

United States Patent [19]

Valero-Cuevas et al.

[11] Patent Number: 6,000,193

[45] Date of Patent: Dec. 14, 1999

[54] EASILY ADJUSTABLE, REUSABLE ARCH-FORMING ASSEMBLY FOR CREATING A FRAMEWORK FOR CONSTRUCTING ARCHES AND ARCHWAYS

[76] Inventors: Francisco Javier Valero-Cuevas, 490 Orange Ave. #A., Los Altos, Calif. 94022; Raimund Sulzenbacher, Winklernfeld 7, A-6370 Kitzbühel; Stefan Hetzenauer, Weinberg 44, A 6365 Kirchberg, both of Austria

[21] Appl. No.: 09/033,864

[22] Filed: Mar. 3, 1998

Related U.S. Application Data

[60] Provisional application No. 60/042,520, Apr. 1, 1997.

[51] Int. Cl.[6] ..... E04F 21/00; E04B 1/32

[52] U.S. Cl. ..... 52/749.13; 52/749.1; 52/DIG. 1

[58] Field of Search ..... 52/749.1, 749.13, 52/DIG. 1, DIG. 2, 86, 88, 89

[56] References Cited

U.S. PATENT DOCUMENTS 5,305,576 4/1994 Giles ..... 52/749.13 X 5,537,805 7/1996 Allman ..... 52/749.13

FOREIGN PATENT DOCUMENTS 1950907 8/0000 Germany .

1432142 4/1976 United Kingdom .

*Primary Examiner*—Christopher T. Kent

*Attorney, Agent, or Firm*—Lumen Intellectual Property Services

[57] ABSTRACT

A reusable and adjustable arch-forming assembly employing a flexible sheet for placing construction materials thereon for the purpose of constructing an arch. The assembly has a center pole with a vertex support and two cross beams mounted by their proximal ends in slidable members engaged around the center pole. Each cross beam has an arch end support at its distal end. An auxiliary support mechanism aids in setting the inclination of the cross beams with respect to the center pole and provides mechanical support for the cross beams at the set inclination. The arch is defined by a curvature assumed by the flexible sheet between the vertex support and the two end support mechanisms. Supplementary arrangements of the assembly permit one to prepare any desired arch structure by adjusting the curvature of the flexible sheet.

34 Claims, 12 Drawing Sheets

EASILY ADJUSTABLE, REUSABLE ARCH-FORMING ASSEMBLY FOR CREATING A FRAMEWORK FOR CONSTRUCTING ARCHES AND ARCHWAYS

RELATED APPLICATIONS

This application is based on U.S. Provisional Pat. App. Ser. No. 60/042,520 filed Apr. 1, 1997, German Patent Application DE-29714297.6 filed Aug. 12, 1997 and European Patent Application EP-97103435 filed Apr. 14, 1997.

FIELD OF THE INVENTION

This invention relates to a mechanical assembly used in supporting a framework upon which building materials are placed to construct an arch or the like.

BACKGROUND OF THE INVENTION

The building of arches generally requires that a non-reusable wooden support structure or arch-forming assembly be prepared for constructing each arch. This approach is time-consuming and costly because the assembly materials are nonreusable. Austrian patent AU-B-69 705/81 teaches a reusable, arch-forming assembly which has a central hub positioned within the arch. A number of swivelable support arms resembling spokes are attached to this hub and extend away from it. Each support arm is swivelably or firmly attached to a flexible sheet at an anchoring point. The length of each support arm can be adjusted to set various arch shapes and/or spans. The arm adjustment process is time-consuming and cumbersome because a number of points along the arc have to be fixed such that the flexible sheet assumes the desired curvature.

A reusable arch-forming assembly having two parts is described in European Patent EP-A-01 36 906. The parts are hinged to make it possible to construct pointed arches. A plurality of support arms are swivelably mounted on a central hub and firmly attached to flexible sheets by their other ends. The hinge has a lever mechanism to enable the construction of round and circular arches. The adjustment of the multiple arms is cumbersome and time-consuming.

German Patent DE-A-22 60 847 discloses an adjustable arch-forming assembly with one flexible sheet carried by a number of support arms extending radially away from a central hub clamp. The length of the arms is adjustable. Varying the span and/or shape of the arch in this arch-forming assembly is time-consuming and difficult.

In an adjustable arch-forming assembly for making section arches or pointed arches described in German Patent DE-A-23 34 020 a number of spoke-like support arms are fastened to a central hub clamp. Each support arm has joint near the flexible sheet, such that the end of each arm can be pivoted with respect to the flexible sheet at the joint. The sheet has slidable terminal portions for making section arches or arch segments. These terminal portions are also supported by arms. Varying the shape and/or span of the arch is time-consuming and cumbersome.

OBJECTS AND ADVANTAGES OF THE INVENTION

Accordingly, is the primary object of the present invention to provide a structurally simple, easy-to-operate and reusable arch-forming assembly. The arch-forming assembly can be set up by an operator to produce any type of arch. The arch parameter adjustments which the assembly supports include arch shape and span, arch terminal angle and arch type. Advantageously, the arch-forming assembly of the invention can be used to construct arches of any commonly used construction materials including bricks, stones and cement. It is yet another object of the invention to provide for simple transport of the assembly.

SUMMARY OF THE INVENTION

These objectives are attained by an arch-forming assembly of the invention. The arch-forming assembly uses a flexible sheet on which construction materials are placed for building an arch. The assembly has a center pole with a vertex support for upholding the flexible sheet at the internal vertex of the arch. Two cross beams are mounted on opposite sides of the center pole by their proximal ends. The proximal ends are attached to sliding members which are mounted on the center pole. The cross beams have distal ends each of which carries an arch end support for holding the flexible sheet. The inclination of the two cross beams with respect to the center pole is varied by adjusting the position of the sliding members and with the aid of two auxiliary support arms. The support arms also serve as mechanical support for the cross beams at the set inclination. The arch is defined by a curvature assumed by the flexible sheet between three points: the vertex support and the two arch end support mechanisms on each cross beam.

The assembly of the invention has an arrangement for adjusting the position of the arch end support mechanisms. This arrangement forces the arch end support mechanism in at least one cross beam to maintain a certain arch terminal angle a over the range of inclinations available to that cross beam. For example, the arch terminal angle can be maintained at 0 degrees with respect to the center pole or it can be set at any value ranging from 0 to 75 degrees or at negative values ranging from 0 to −75 degrees.

The flexible sheet used in the assembly of the invention can be made up of one or more sheet sections. When the sheet has two sections the junction between them can be positioned at the internal vertex to build a pointed arch. The sections are typically joined by a hinge.

The sliding members mounted on the center pole have a releasable latch, preferably with a spring-loaded or otherwise biased mechanism for automatically locking or latching on the center pole.

In the preferred embodiment of the invention the vertex support has a fastening pin. The flexible sheet is equipped with a mating grip for attaching it to the fastening pin.

The arch end support mechanism has a clamping surface and a corresponding U-shaped clasp for holding the flexible sheet against the clamping surface. Preferably, the clasp can hold the sheet at any arch terminal angle $\alpha$. The clasp itself is easily fastened to the support mechanism by providing its two opposing arms with bores for receiving a lynch pin or peg. A spring-loaded catch is used to arrest the peg when the sheet is clamped on the arch end support mechanism. The peg can also be moved with respect to the clamping surface to ensure a tighter grip of the clasp on the flexible sheet.

In the preferred embodiment the cross beams have a predetermined range of inclinations and each one consists of an upper strut and a lower strut. Both struts are pivoted such that they retain their parallel alignment over the predetermined range of inclinations. Preferably, the sliding members are replaced by a single central slider and both the upper and lower struts are connected at the cross beams' distal ends by connecting elements. The arch end support mechanism is conveniently mounted on this connecting element. Furthermore, the central slider has an upper pivot joint for attaching the upper strut and a lower pivot joint for attaching the lower strut, with at least one of the pivot joints being adjustable.

In another embodiment, the arch end support mechanism has a swivelable clamp for holding the flexible sheet at arch terminal angle α.

Use of the assembly is further simplified by markings on the two auxiliary support arms indicating the inclinations of the cross beams with respect to the center pole. Additionally, the support arms are equipped with locking devices for fixing the inclinations of the cross beams. In the preferred embodiment the two support arms are arcuate and are swivelably attached to the center pole. Each arch end support mechanism has releasable locking mechanism for guiding its corresponding support arm and anchoring it such that the inclination of each cross beam is fixed. The locking mechanism is typically a spring-loaded bolt and the support arms have holes for engaging the bolt at selected inclinations. An additional set hole is provided such that the cross beam is approximately parallel to the center pole when the bolt is engaged in this hole. In this position the entire assembly can be easily transported.

The preferred embodiment of the arch-forming assembly of the invention includes a bar extending parallel to the center pole. The bar has a top end or head portion and a bottom end or foot portion. The foot portion is attached to the sliding members or the single central slider while the head portion is slidably attached to the center pole. The head portion is equipped with suitable mounting joints or the like for carrying the two auxiliary support arms. The assembly also has a stationary ruler extending parallel to the bar. The ruler is provided with stationary and movable markings or indicators for setting the position of the bar along the center pole to thus adjust the shape of the curvature and the span of the arch.

To further simplify the process of dimensioning the arch the flexible sheet has arch span markings on either the inner or outer surface.

In alternative embodiments the arch-forming assembly has two telescopic cross beams mounted in the sliding members or on the single central slider. These telescopic beams extend and retract in a direction perpendicular to the center pole. The telescoping beams can also be mounted to extend and retract in a direction at a certain slope with respect to the center pole. For added mechanical stability a brace oriented perpendicular to the center pole connects the sloping cross beams. Finally, the cross beams can also be made of a scissors-like strut assembly. These types of cross beams extend and retract in a direction more or less perpendicular to the center pole.

A detailed description of the arch-forming assembly and its applications is set forth below in reference to the accompanying drawing figures.

DETAILED DESCRIPTION STRUCTURE OF THE PREFERRED EMBODIMENT

Figure 1:
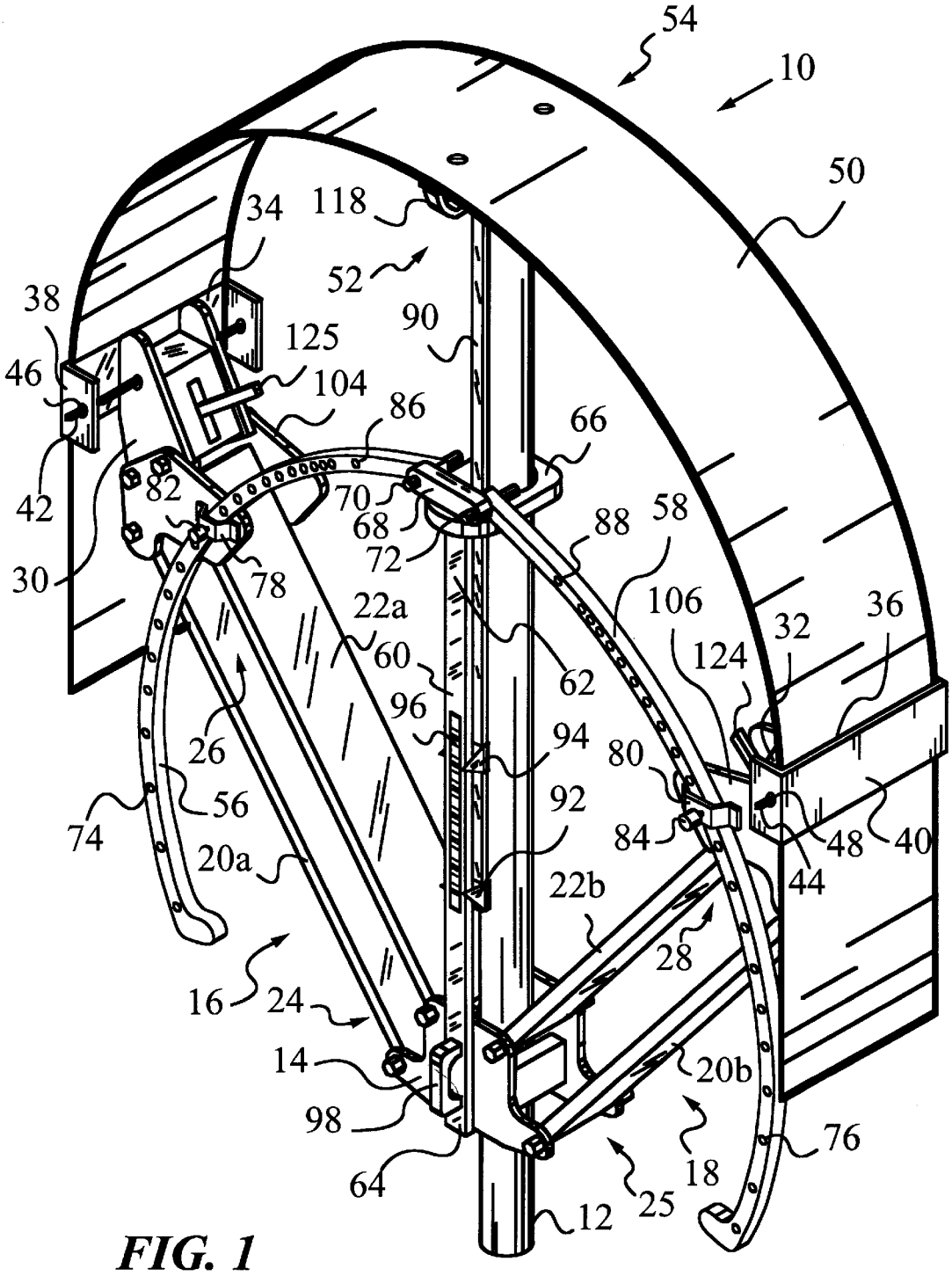
FIG. 1 is an isometric view of an arch-forming assembly according to a preferred embodiment of the present invention.

The preferred embodiment of an arch-forming assembly 10 according to the invention is shown in FIGS. 1–5. FIG. 1 shows a right isometric view of assembly 10 ready for use.

A center pole 12 constitutes the central portion of assembly 10. A central slider 14 is mounted on pole 12 and rests near its bottom. Two cross beams 16 and 18, each having a lower strut 20*a*, 20*a* and an upper strut 22*a*, 22*b* are mounted by their proximal ends 24 and 25 in central slider 14.

Distal ends 26 and 28 of cross beams 16 and 18 carry arch end support mechanisms 30 and 32 respectively. Each arch end support mechanism 30, 32 is equipped with a clamping surface 34, 36 and corresponding U-shaped clasp 38, 40. Lynch pins or pegs 42, 44 pass through bores 46, 48 in the two opposing arms of clasps 38, 40 and through arch end support mechanisms 30, 32.

A flexible sheet 50 is held against clamping surfaces 34 and 36 by clasps 38 and 40. Sheet 50 is made of a flexible, elastic material in order to bear internal tension and compression while retaining its shape when construction materials 15 (see FIG. 2), e.g., bricks, cement or the like are placed thereon. Suitable materials include sheet metal, synthetic materials, wood or the like. Composited materials, especially fiber-reinforced synthetic materials, similar to those used in the manufacture of snow skis, are especially well-suited for this purpose.

Flexible sheet 50 is also supported at a vertex support 52 of center pole 12. In fact, vertex support 52 upholds sheet 50 at the internal vertex of an arch 54 which is defined by the curvature assumed by flexible sheet 50 between three points: vertex support 52 and the two arch end support mechanisms 30 and 32.

Assembly 10 has two arcuate auxiliary support arms 56, 58. Support arms 56, 58 are attached by their ends to a head portion 62 of a bar 60 extending parallel to center pole 12. Bar 60 is permanently joined by its foot portion 64 to central slider 14. Head portion 62 bears a sliding element 66 girding center pole 12 and designed to slide up and down on pole 12. Element 66 is provided with a joint 68 and mounting pins 70 and 72 by which support arms 56 and 58 are attached to head portion 62 in a swivelable manner. Support arms 56, 58 also have markings, in this case notches or holes 74 and 76 respectively, for indicating the inclinations of cross beams 16 and 18 with respect to center pole 12, thus defining the distance between end support mechanisms 30, 32. The distance between support mechanisms 30, 32 is the arch diameter.

Two releasable locking devices 78, 80 in the form of retaining loops through which support arms 56, 58 pass are attached to arch end support mechanisms 30 and 32. Releasable locking mechanisms 82 and 84 are responsible for the locking action of devices 78, 80. Locking mechanisms 82, 84 are spring-loaded bolts which cooperate with holes 74 and 76.

In FIG. 1 mechanisms 82 and 84 are shown engaged and thus the cross beams 16 and 18 are securely anchored by support arms 56, 58 and the inclinations of cross beams 16 and 18 are fixed. At the same time, support arms 56 and 58 serve a very important second function by providing mechanical support to cross beams 16, 18. Specifically, a portion of the force of weight of construction materials 15 placed on flexible sheet 50 and borne by cross beams 16 and 18 is transferred to support arms 56 and 58.

Additional set holes 86 and 88 are made in support arms 56, 58. When bolts 82, 84 are engaged in set holes 86, 88 cross beams 16, 18 are almost parallel to center pole 12. In this position arch-forming assembly 10 can be easily transported.

Of course, other releasable locking devices and locking mechanisms can be substituted for those described above, e.g., clamps, screws, traction devices and the like. These devices serve the same mechanical functions of fixing the inclination of cross beams 16, 18 and mechanically supporting them. A person of average skill in the art will be able to determine how to implement embodiments with these alternative mechanisms.

Arch-forming assembly 10 has a stationary ruler 90 extending parallel to bar 60. Ruler 90 is located between bar 60 and center pole 12. Markings in the form of a permanently fastened or stationary indicator 92 and a sliding indicator 94 are mounted on ruler 90. Indicators 92 and 94 cooperate with a scale 96 on bar 60 and are used to set the position of bar 60 along center pole 12. In turn, the position of bar 60 along center pole 12 determines the height of arch 54 since moving bar 60 adjusts the vertical distance between end support mechanisms 30, 32 and the internal vertex of arch 54. Specifically, displacement of bar 60 along center pole 12 causes a corresponding movement of proximal ends 24, 25 of cross beams 16, 18 as well as support arms 56 and 58 at mounting pins 70, 72. A handle 98 is affixed to foot portion 64 to enable an operator to more easily slide bar 60 along center pole 12.

Figure 5A:
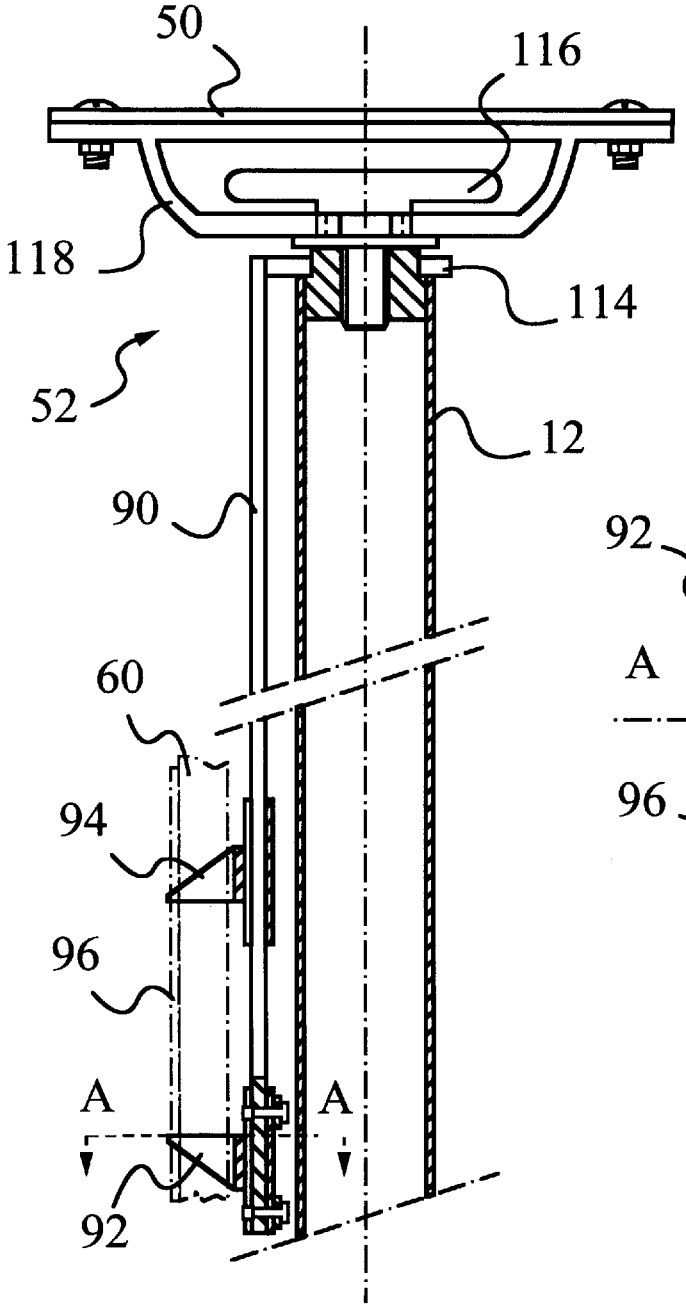
FIG. 5A is a cross sectional view of the center pole of the assembly of FIG. 1.
Figure 5B:
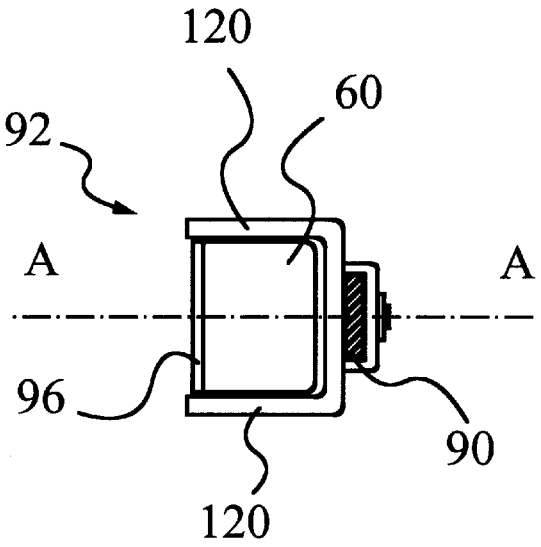
FIG. 5B is a cross sectional view of an indicator used in the assembly of FIG. 1.

FIG. 5A and B show in more detail stationary indicator 92 and sliding indicator 94. Stationary indicator 92 is screwed in, bolted or otherwise attached to the lower end of ruler 90. Sliding indicator 94 is attached to ruler 90 above stationary indicator 92. Both indicators 92, 94 have two arms as shown in the cross sectional view of indicator 92 along line A—A in FIG. 5B. The arms reach around bar 60 and terminate in pointers 120 on either side. Pointers 120 indicate a setting on scale 96.

Figure 2:
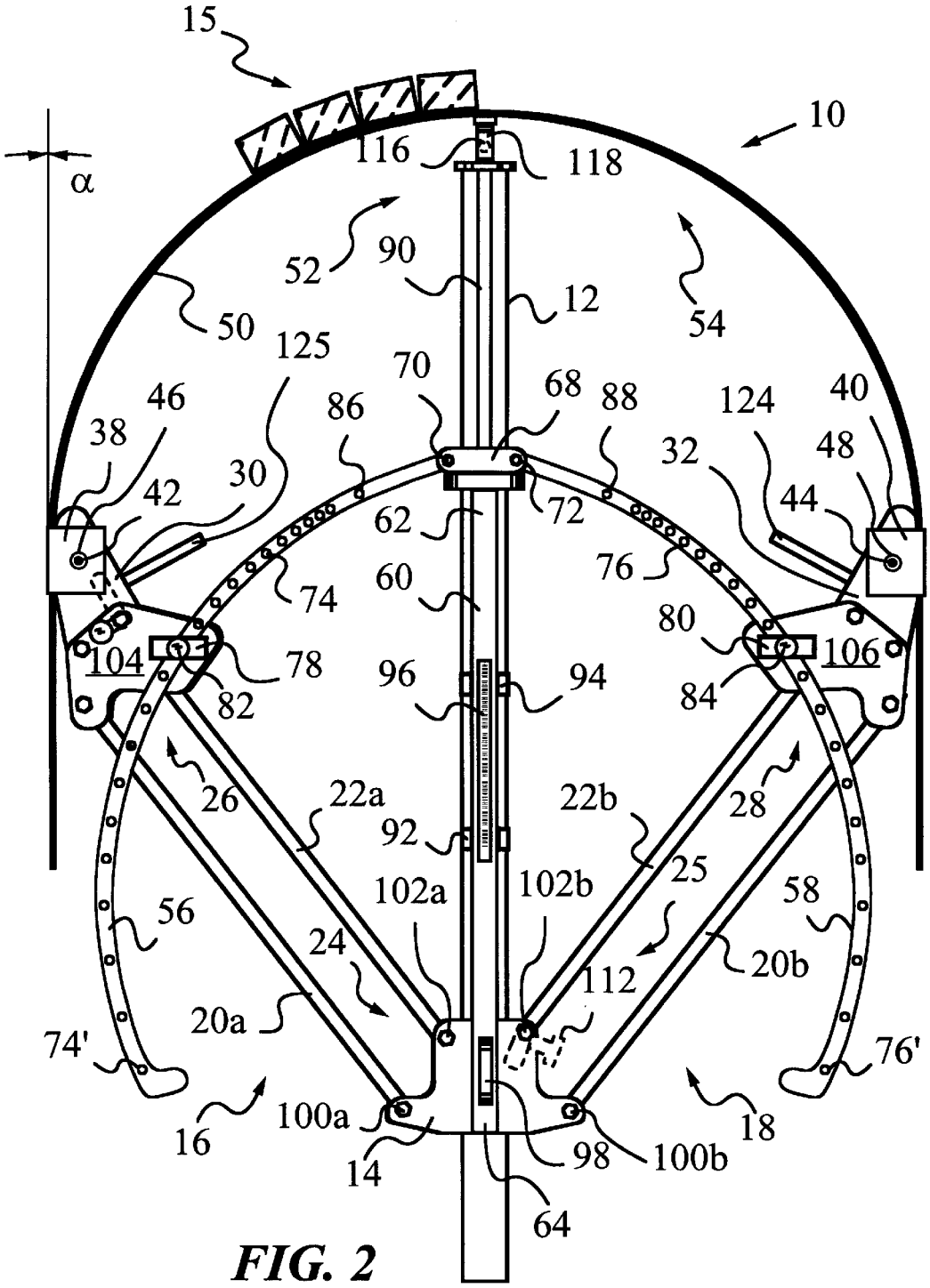
FIG. 2 is a front plan view of the arch-forming assembly of FIG. 1.

Referring now to the front view of FIG. 2, it is evident that upper struts 22*a*, 22*b* are parallel to lower struts 20*a*, 20*b*. Each upper strut 22*a* and 22*b* is pivoted at respective proximal end 24, 25 in upper pivoting joints 102*a*, 102*b*. Analogously, each lower strut 20*a* and 20*b* is pivoted at respective proximal end 24, 25 in lower pivoting joints 100*a*, 100*b*.

Figure 3A:
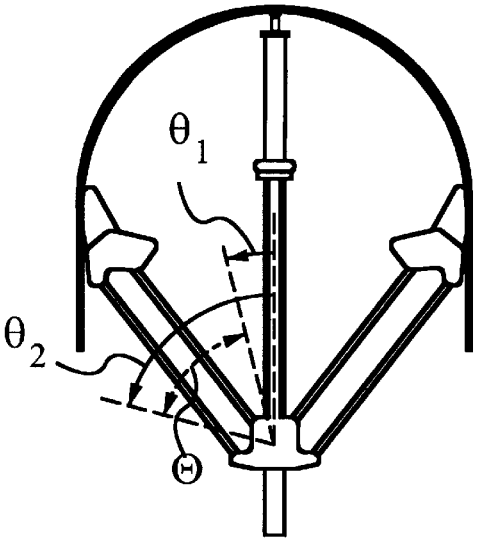
FIGS. 3A–C are front views indicating three different inclinations of cross beams in the arch-forming assembly of FIG. 1.
Figure 3B:
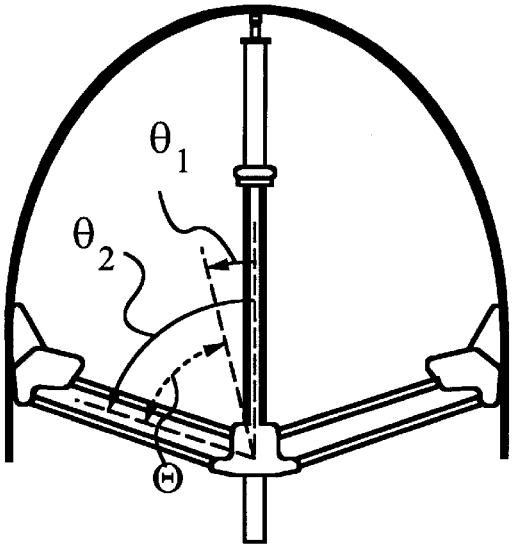
Figure 3C:
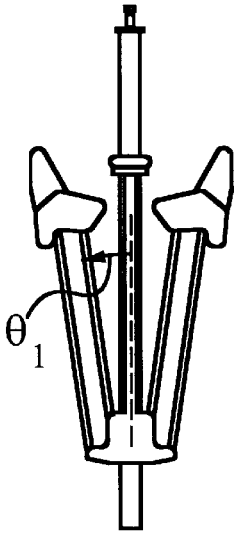

As a result, cross beams 16, 18 are pivotable in center slider 14 over a range of inclinations Θ. At one end of range Θ the angle of inclination $\theta_1$ of cross beam 16 with respect to center pole 12 is nearly zero. This occurs when support arm 56 is locked in set hole 86 and the resulting set-up is shown in FIG. 3C. In fact, when both cross beam 16 and cross beam 18 are arrested in set holes 86, 88 arch-forming assembly can be easily transported; hence, this set-up is called the transport position. At the other extreme of range Θ the angle of inclination $\theta_2$ of cross beam 16 is nearly 90 degrees with respect to center pole 12 as shown in FIG. 3B. This happens when support arm 56 is locked in hole 74' at the terminal end of support arm 56. Inclination range Θ for cross beam 18 is analogous to that of cross beam 16 in this embodiment. An inclination in about the middle of inclination range Θ is shown in FIG. 3A.

Referring back to FIG. 2, each pair of struts 20*a*, 22*a* and 20*b*, 22*b* is joined at distal ends 26, 28 by connecting elements 104 and 106. The joints are pivotable. Consequently, in both cross beams 16 and 18, struts pairs 20*a*, 22*a* and 20*b*, 22*b* retain their parallel orientation with respect to each other over the range of inclinations Θ. This parallel guidance condition or forced parallelogram is clearly shown in FIGS. 3A–C. The parallel guidance ensures that the orientation of arch end support mechanisms 30, 32 mounted on connecting elements 104 and 106 respectively is preserved over the range of inclinations Θ. This preservation of orientation is apparent in reviewing FIGS. 3A–C.

Figure 4A:
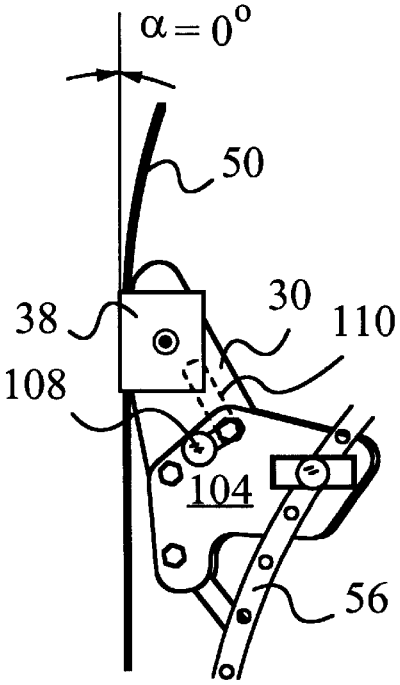
FIGS. 4A–B are partial front views of an arch end support mechanism of the arch-forming assembly of FIG. 1.
Figure 4B:
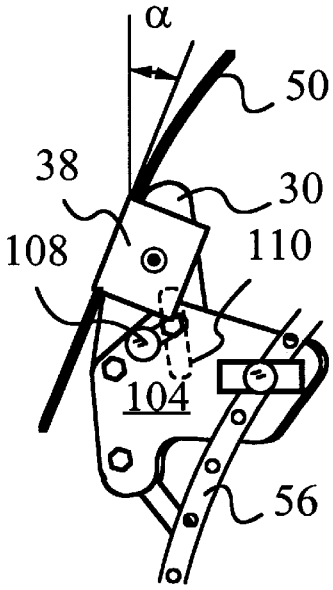

As shown in FIGS. 4A–B arch end support mechanism 30 has an arrangement consisting of a bolt 108 and a sliding notch 110 for adjusting the tilt of support mechanism 30. Support mechanism 32 has an analogous arrangement (not shown). In FIG. 4A bolt 108 is locked such that support mechanism is upright. As a result, an arch terminal angle α of sheet 50 with respect to center pole 12 at clamp 38 is minimal or approximately 0 degrees. In FIG. 4B support mechanism 30 is tilted forward and arch terminal angle α is consequently large. Preferably, the range of arch terminal angles which can be set should extend from 0 degrees to 75 degrees with respect to center pole 12. However, other embodiments can allow terminal angle α to extend into the negative range (see, e.g., FIG. 16E).

Adjusting and fixing the tilt of support mechanism 30 fixes a certain arch terminal angle α. Due to the forced parallelogram condition angle α is preserved over the inclination range Θ. Furthermore, arch terminal angle α can be set independently for support mechanisms 30 and 32 for nonsymmetrical arches. In other words, arrangements for adjusting the tilt of support mechanisms 30 and 32 make it possible to set the arch terminal angles of arch 54 and maintain these angles at various inclinations of cross beams 16, 18.

Referring back to FIG. 2, arch-forming assembly 10 is shown with one of the pivot joints on central slider 14 being adjustable. Specifically, upper pivot joint 102*b* to which upper strut 22*b* is connected is adjustable be means of an arrangement 112. Arrangement 112 can be analogous to the arrangement 108, 110. Adjusting the position of pivot joint 102*b* changes arch terminal angle α by altering the parallel alignment of struts 20*b* and 22*b*. Consequently, arrangement 112 can be used together with arrangement 108, 110 or independently for setting the arch terminal angles of arch 54.

FIG. 5A illustrates center pole 12 in cross section with flexible sheet 50 held at vertex support 52. Vertex support 52 consists of a termination piece 114 mounted on top of center pole 12. Ruler 90 is joined by its top end to piece 114. A fastening pin 116 with its handle oriented in a plane perpendicular to center pole 12 is mounted on top of center pole 12. Fastening pin 116 can be screwed in and unscrewed. Flexible sheet 50 has a handle or mating grip 118 which is held in place by fastening pin 116. Thus, flexible sheet 50 is easily mounted at vertex support 52 by placing grip 118 under fastening pin 116 and screwing it in.

Figure 6:
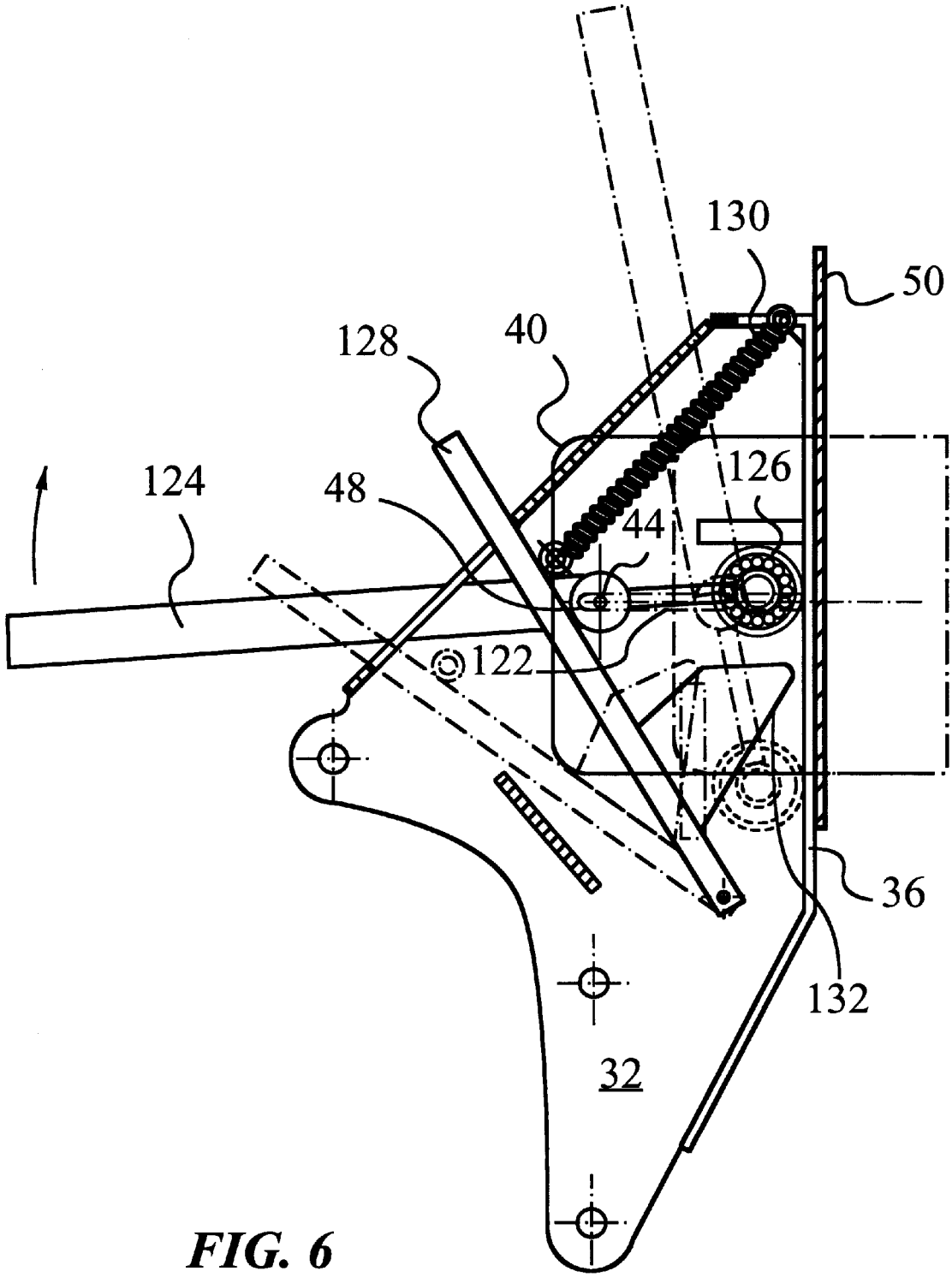
FIG. 6 is a front cross sectional view of an arch end support mechanism used in the assembly of FIG. 1.

FIG. 6 shows arch end support mechanism 32 of the preferred embodiment in more detail. Flexible sheet 50 is clamped on clamping surface 36 by clasp 40 and peg 44 is in place inside bore 48. Peg 44 further passes through slit 122 in support mechanism 32. A locking handle 124 is shown in the locked position (solid lines) in which peg 44 is arrested in the front of slit 122. In this position flexible sheet 50 is securely clamped against surface 36.

Conveniently, locking handle 124 is mounted on a ball bearing 126 which rolls on the inner side of clamping surface 36. The dashed and dotted lines show locking handle 124 in the unlocked position with bearing 126 positioned low on the inner side of surface 36.

A spring-loaded catch 128 biased by a spring 130 is urged upward and causes bearing 126 to be locked in place by a stop or projection 132. The solid line shows catch 128 in the secure or locked position. The dashed and dotted lines show catch 128 in the release position when locking handle 124 can be swung up to remove clasp 40. Clearly, a person of average skill in the art will be able to derive many analogous arrangements for securely mounting and seating clasp 40 to firmly grip and press flexible sheet 50 against clamping surface 36. Arch end support mechanism 30 is conveniently equipped with an analogous locking handle 125 and internal mechanism.

Figure 7:
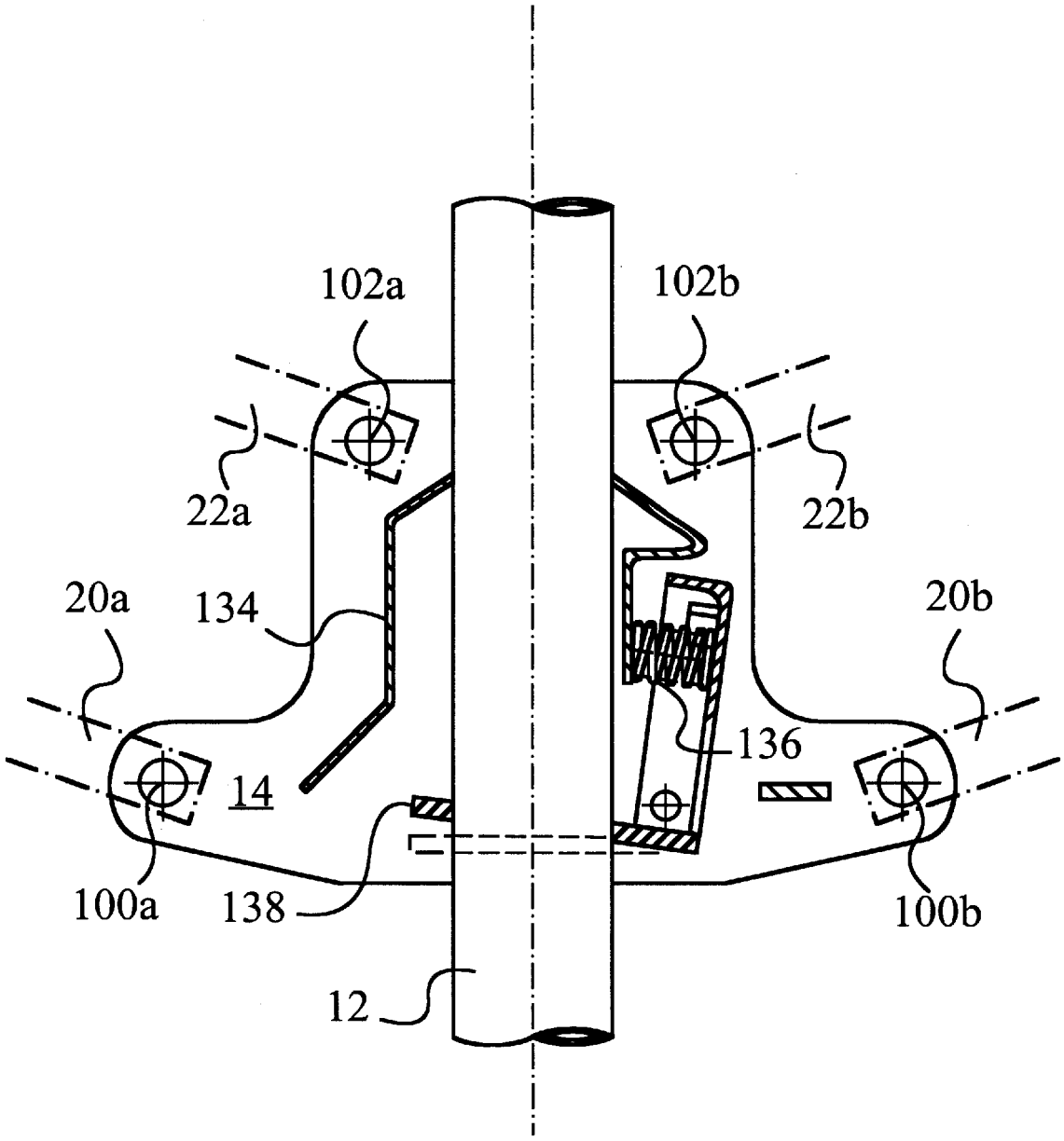
FIG. 7 is a front cross sectional view of a central slider used in the assembly of FIG. 1.

FIG. 7 is a more detailed front cross sectional view of central slider 14. On the inside, central slider has a brace 134 encircling central pole 12. A locking spring 136 is mounted with one end on brace 134 and with the other end on a tilting mechanism 138 which automatically locks on center pole 12 due to spring pressure exercised by locking spring 136. In effect, spring pressure causes mechanism 138 to tilt and lock on center pole 12. Of course, other simple mechanisms can be substituted by a person of average skill in the art to achieve the same automatic locking effect.

OPERATION OF THE PREFERRED EMBODIMENT

Arch-forming assembly 10 is very easy to use by a brick layer or construction worker. Since flexible sheet 50 is only held by two arch support mechanisms 30, 32 and a vertex support 52 it is free to bend between these three points to assume its natural curvature. All that is required is that cross beams 16 and 18 be fixed at a given inclination within range Θ and at a vertical position along center pole 12 so as to define the ends of arch 54; typically in relation to the arch vertex support 52. This can be performed easily and quickly with just a few manual operations. All arch shapes and widely varying spans are allowed. Center pole 12 may be used for carrying assembly 10 in the transport position (see FIG. 3C) and setting it up at the construction site preferably without any additional mechanisms.

Freely bending flexible sheet 50 makes it possible to set up well-shaped and aesthetically pleasing arches 54 as long as bent flexible sheet 50, thanks to its makeup and its own tension, is able to carry the weight of arch 54 and construction materials 15 placed on top of it without undergoing significant deformations. Since cross beams 16, 18 are mechanically supported by auxiliary support arms 56, 58 assembly 10 can easily support the weight of bricks, stones and heavy cement. In the preferred embodiment support arms 56, 58 are pull and push resistant.

For example, using a standard size assembly 10 one can form various types of arches 54 whose span ranges from 70 cm up to 1.7 m. Other span ranges can be accommodated with different basic sizes of assembly 10.

One of the preconditions for practical use is simple operation of assembly 10 at the site, especially when changing the shape or span of arch 54. This is ensured since the auxiliary support arms 56 and 58 which are used by the worker to quickly and precisely set arch 54 in a reproducible manner without time-consuming trials and progressive approximations. Once assembly 10 is properly positioned, these adjustments can be easily made even by an untrained person by using the support arms 56, 58 and latching them using releasable locking devices 78 and 80. It is always possible to make fine corrections thereafter by adjusting only one support arm to change the angle of inclination of only one support beam 16 or 18 and the height of central slider 14. The asymmetry or slant caused by these fine adjustments in arch 54 is generally not noticeable.

Arch 54 is maintained over the adjustment range of support arms 56, 58. Once the span is set by adjusting the inclination of cross beams 16, 18 and the height of central slider 14 on center pole 12, flexible sheet 50 is forced to assume the correct curvature.

In the special case of circular arches, which enter arch end support mechanisms 30 and 32 tangentially, terminal angle α of arch 54 is set to about 0 degrees. Angle α is preserved over inclination range Θ of cross beams 16, 18 be cause of the forced parallelogram between upper and lower strut pairs 22*a*, 20*a* and 22*b*, 20*b*.

In order to set terminal angles α other than 0 degrees (e.g., for segmental arches) a range of about 0 to 75 degrees is provided. Obviously, other implementations can include different ranges of inclinations and terminal angles α, e.g., ranges including negative terminal angles α. A practicable negative range for terminal angles α extends from 0 to −75 degrees.

The setting of a particular shape or span of arch 54 and a clean transition at the end of arch 54 is achieved by changing the length of flexible sheet 50 between vertex support 52 and arch end support mechanisms 30 and 32. This is done by unclamping clasps 38 and 40 using locking handles 125 and 124, moving sheet 50, and reclamping. This is especially important for arch shapes forming an obtuse angle α at the transition at the end of arch 54. The unused portion of sheet 50 is usually accommodated on the sides of assembly 10. The arches which can be made in this manner include round arches, segmental arches or elliptical arches with steep or obtuse terminal angles α.

Sheet 50 can be replaced with another sheet, e.g., narrower, wider, thicker, longer, stronger or otherwise different sheet, by unscrewing fastening pin 116, removing sheet 50 by its grip 118, mounting the new sheet 50 by its grip 118 and tightening pin 116. Modifications to end support mechanisms 30, 32 can be made to accomodate sheets 50 of different dimensions.

Locking handle 124 with cooperating spring-loaded catch 128 ensures that sheet 50 does become free by itself, e.g., under its own flexural stress. This is especially important in difficult working conditions at the construction site.

In certain situations the operator can adjust the arch terminal angle α by using arrangement 112.

ALTERNATIVE EMBODIMENTS

Figure 8:
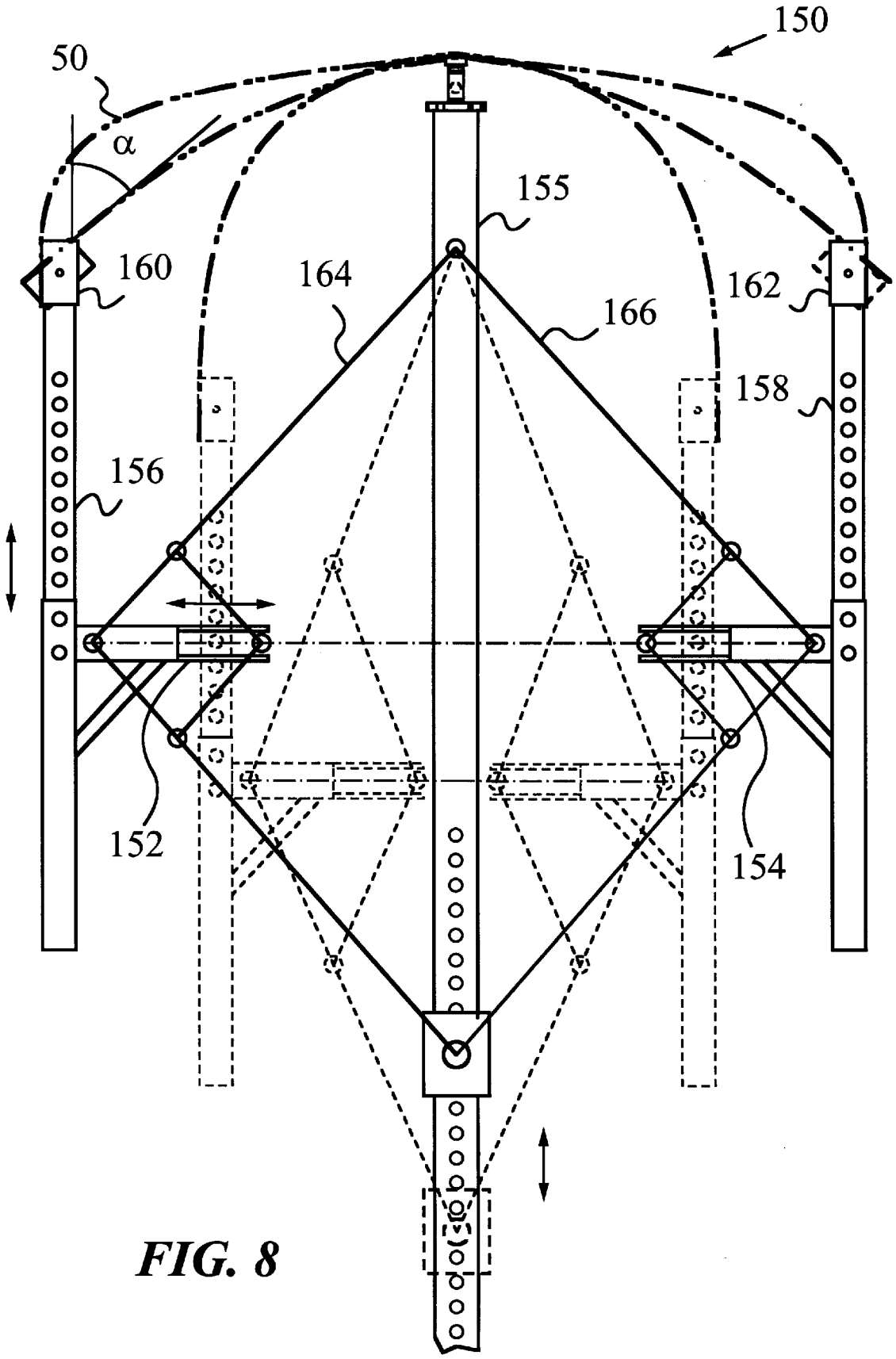
FIG. 8 is a front plan view of an alternative embodiment of an arch-forming assembly.

It will be appreciated by a person of average skill in the art that arch-forming assembly 10 can be altered in many ways. In an alternative embodiment an arch-forming assembly 150 shown in FIG. 8 has telescoping cross beams 152, 154. Cross beams 152, 154 are designed to extend and retract in a direction perpendicular to center pole 155. Arch end support mechanisms 156, 158 have swivelable clamps 160, 162 which allow the user to easily fix and maintain flexible sheet 50 at preselected terminal angles α. Auxiliary support mechanism consists of cables 164, 166 which may be marked to assist the user in setting specific arch parameters. Cables 164, 166 also carry a portion of the load resting on sheet 50. In some applications, e.g., when working with heavy construction materials, cables 164, 166 can be replaced by struts or other mechanically stable elements to ensure proper mechanical support of cross beams 152, 154.

The dotted lines show a setting of assembly 150 in which cross beams 152, 154 are retracted inward and sit low on center pole 155.

Figure 9:
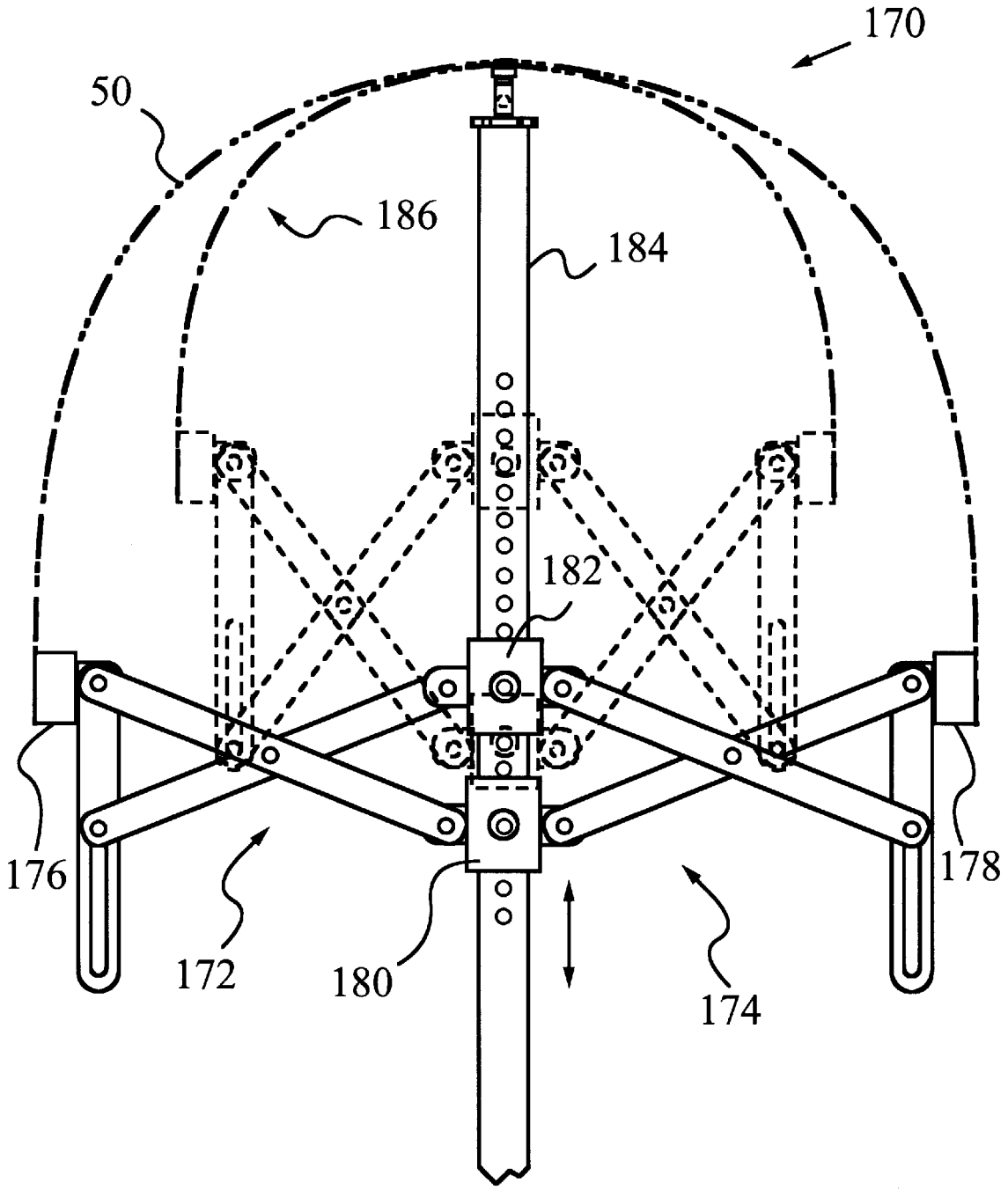
FIG. 9 is a front plan view of another alternative embodiment of an arch-forming assembly.

FIG. 9 illustrates an embodiment of an arch-forming assembly 170 employing a scissors-type strut assemblies 172 and 174 as the cross beams. Clamping devices 176, 178 are mounted at the outer ends of assemblies 172, 174. In this case, two sliding members 180 and 182 mounted on central pole 184 are required to operate assemblies 172, 174. An alternative setting of assemblies 172, 174 for a smaller arch 186 is indicated in dotted lines.

Figure 10:
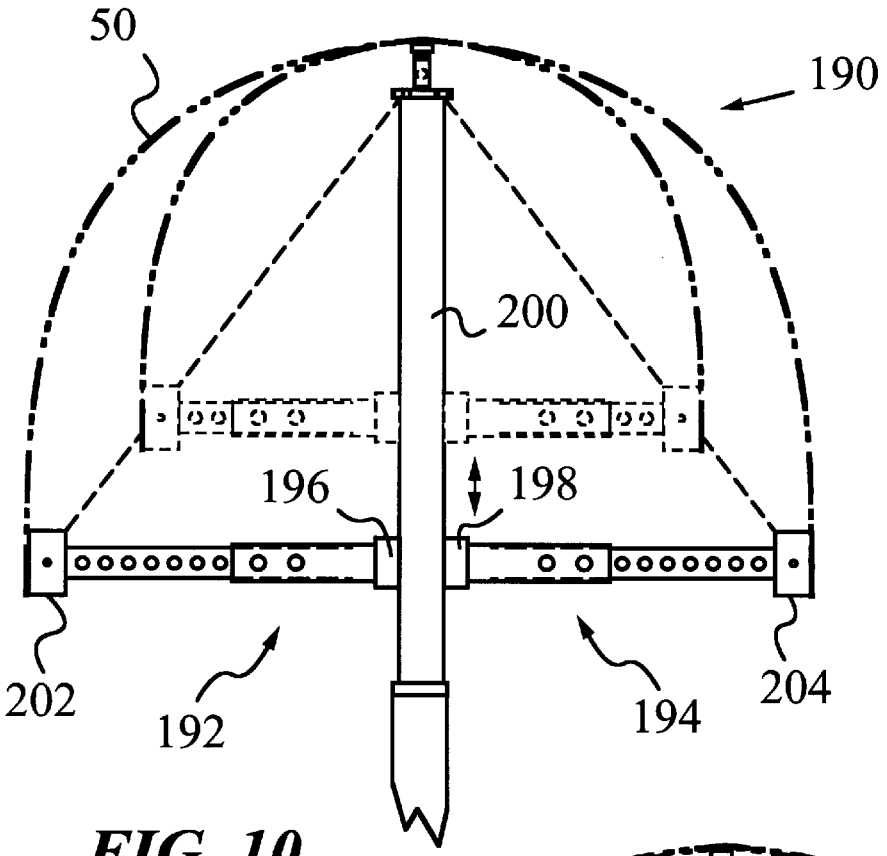
FIG. 10 is a front plan view of yet another embodiment of an arch-forming assembly.

FIG. 10 shows an arch-forming assembly 190 with telescopic cross beams 192, 194 mounted in sliding members 196, 198 mounted independent of each other on center pole 200. Any of the auxiliary support mechanisms described above can be used to mechanically support telescopic cross beams 192, 194 in order to avoid deflection or bending of cross beams 192, 194 under load and prevent unwanted sliding of sliding members 196, 198. Clamps 202 and 204 attached at the ends of beams 192, 194 alone serve the function of arch end support mechanisms. Preferably, clamps 202, 204 are pivotable, like clamps 160, 162 of the embodiment shown in FIG. 8, to enable the operator to easily set arch terminal angles α.

Figure 11:
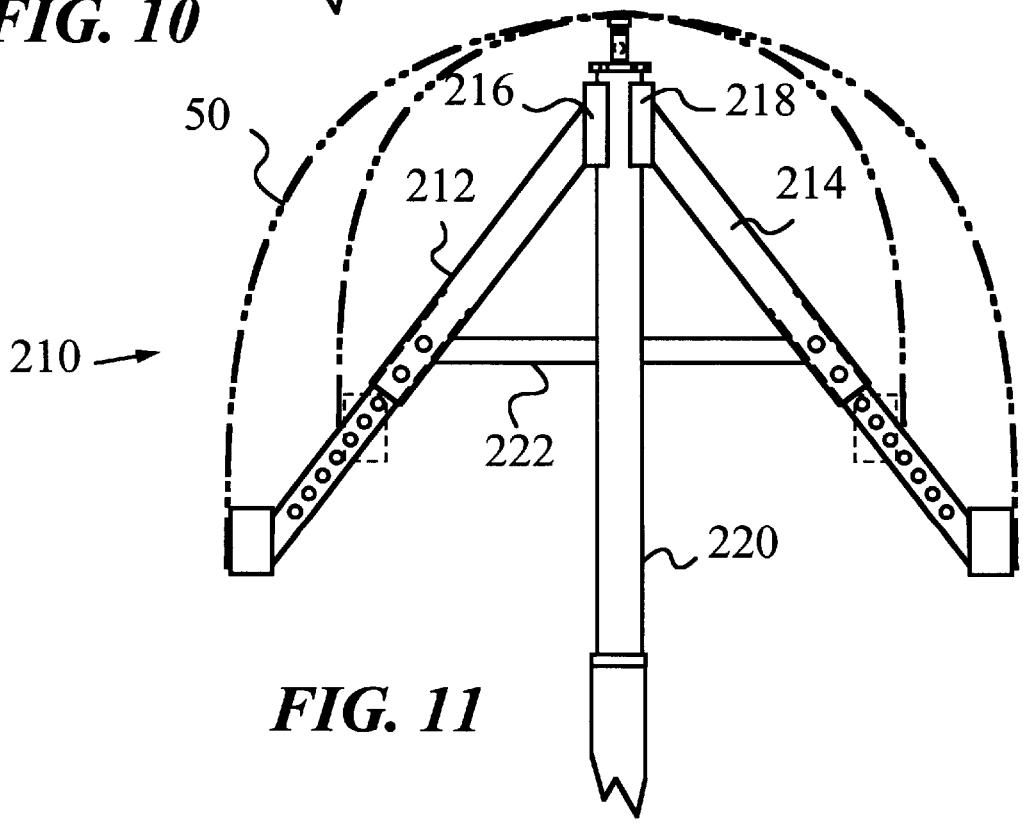
FIG. 11 is a front plan view of an embodiment of an arch-forming assembly with downward sloping cross beams.

Arch-forming assembly 210 of FIG. 11 is similar to assembly 190 of FIG. 10 in that it has telescoping cross beams 212 and 214. In contrast to FIG. 10, however, cross beams 212 are mounted in sliding members 216, 218 to extend and retract at a certain slope with respect to center pole 220. A brace 222 serves the function of auxiliary support to help set proper arch parameters and to mechanically support cross beams 212, 214. Brace 222 can consist of two independent parts.

Figure 12:
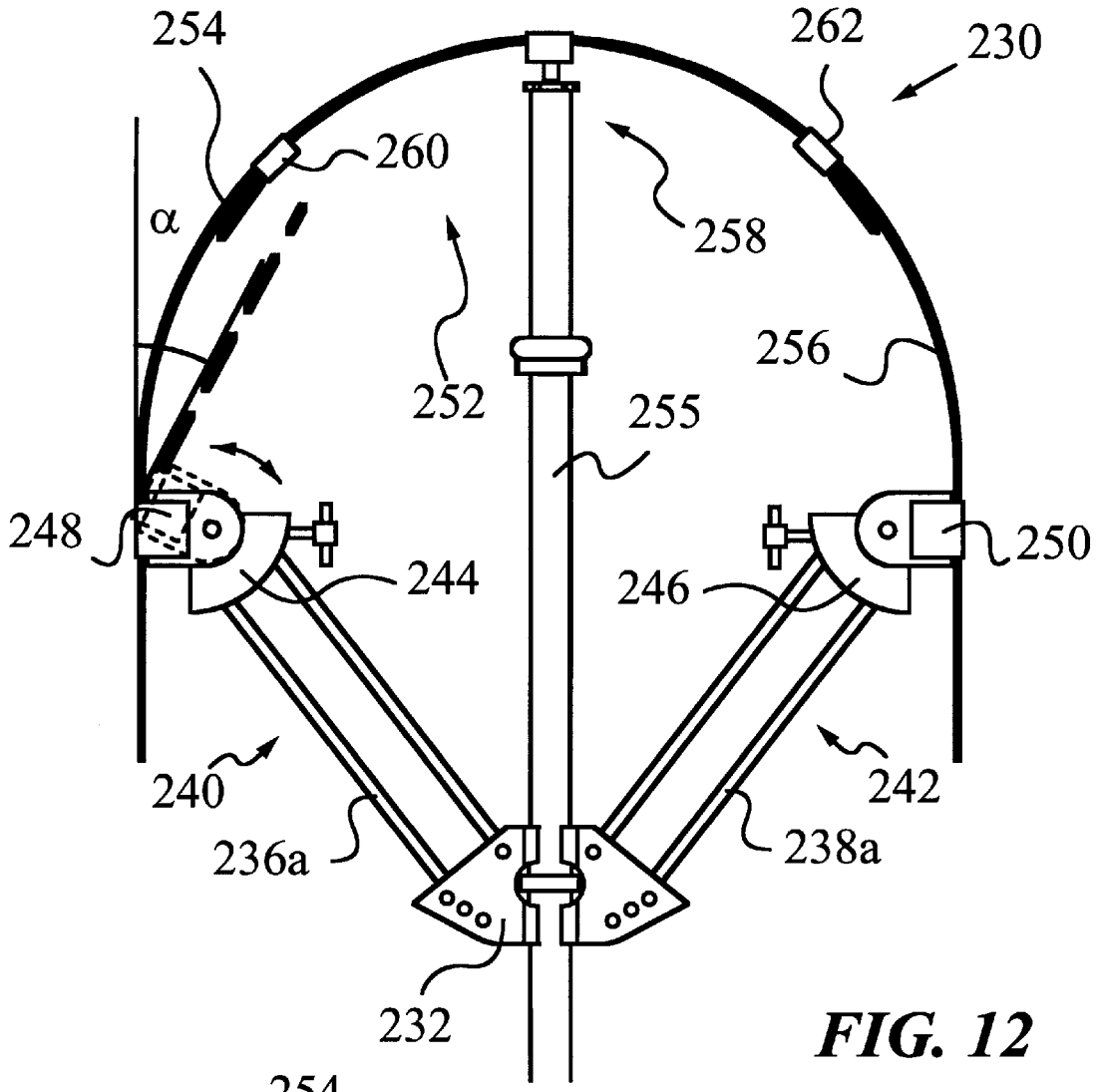
FIG. 12 is a front view of an alternative embodiment related to the preferred embodiment.

FIG. 12 shows an arch-forming assembly 230 related to the preferred assembly 10. Assembly 230 has a single central slider 232 with several notches 234 for adjusting the inclination of lower struts 236*a*, 238*a* of cross beams 240, 242. Arch end support mechanisms 244, 246 have swivelable clamp mechanisms or clamps 248, 250 which permit a user to set a particular terminal angle α on either side of arch 252.

In this embodiment arch 252 is constructed of two flexible sheet sections 254 and 256 which overlap at vertex support 258 of center pole 255. Clips 260, 262 help to keep sections 254 and 256 together on either side of vertex support 258.

Figure 13:
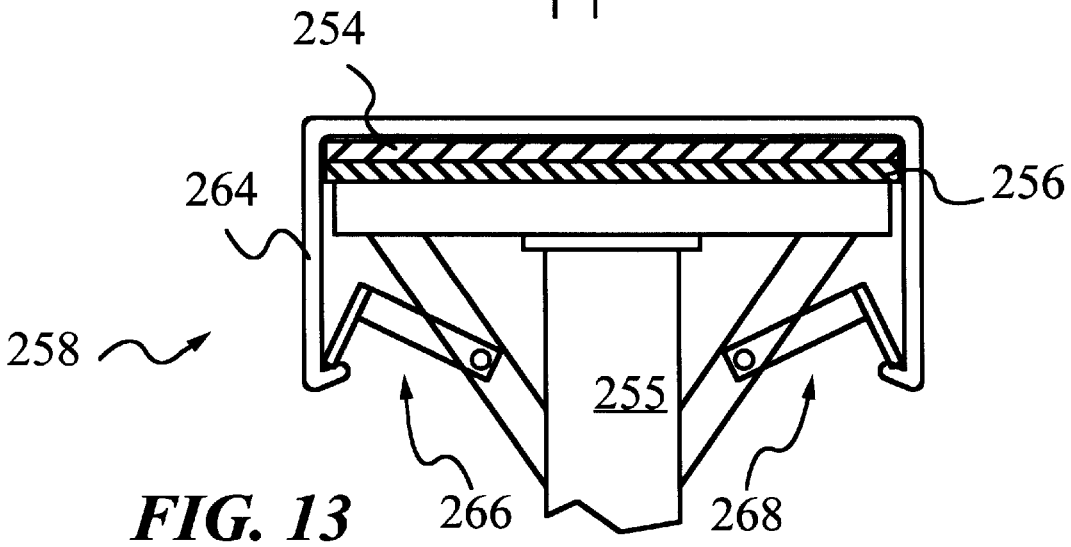
FIG. 13 is a cross sectional view illustrating the vertex support of the arch-forming assembly of FIG. 12.

FIG. 13 shows vertex support 258 in cross section. A clamp 264 seated on sheet sections 254, 256 is used to keep the latter in place. Mechanisms 266, 268 are used to adjust and tighten clamp 264 preferably with the aid of screws (not shown).

Figure 14:
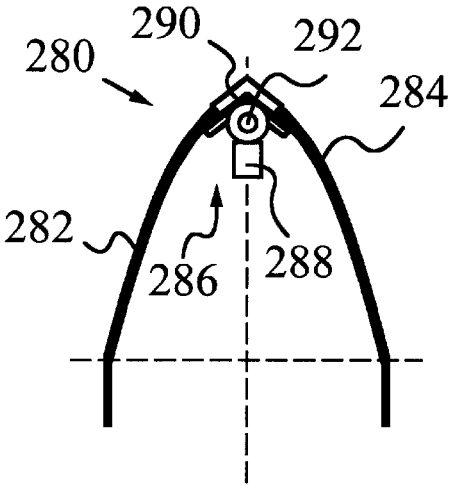
FIG. 14 is a simplified front view of an embodiment designed for making pointed arches.

FIG. 14 is a simplified schematic view of an arch-forming assembly 280 using two flexible sheet sections 282 and 284 to construct a pointed arch 286. Flexible sheets are joined at vertex support 288 by a hinge 290. A hinge support mechanism 292 forms part of vertex support 288. The function of hinge support mechanism 292 is to hold the angle between sheet sections 282 and 284 constant once set.

Figure 15:
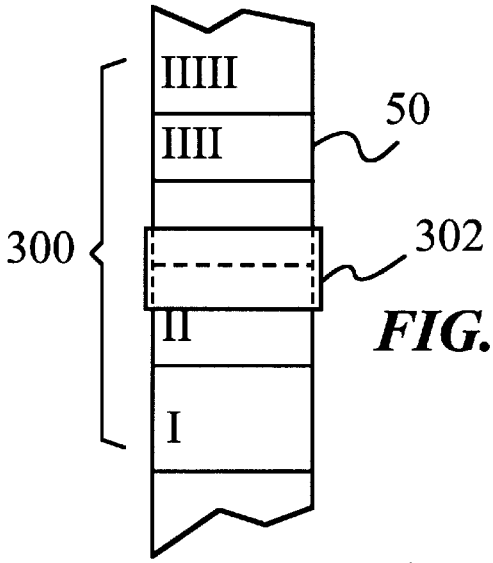
FIG. 15 is a plan view of a marked flexible sheet.

FIG. 15 shows the inner side of flexible sheet 50 bearing markings 300 used in any of the above embodiments to aid the user in setting the proper arch length. Actually, markings 300 can be present on either the inner or outer surface of flexible sheet 50. Usually, markings 300 are more effective on the inner surface since in that case they remain visible thorughout the construction process. Preferably, markings 300 are coordinated with other scales already present on the arch-forming assembly. In this drawing a clasp 302 is shown fitted over marking III corresponding to a well-defined length of sheet 50 from the vertex support.

Figure 16A:
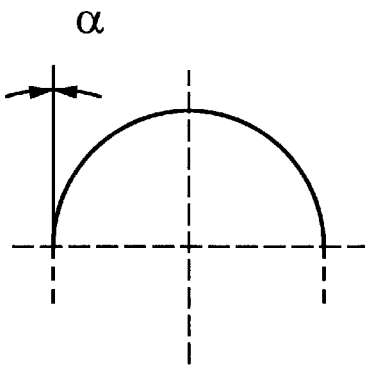
FIG. 16A–I are nine schematic views illustrating fundamental arch types and domes constructed with the arch-forming assembly of the invention.
Figure 16B:
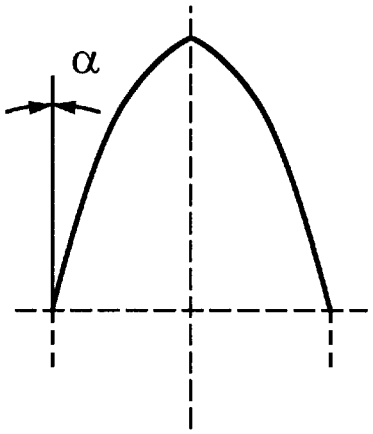
Figure 16C:
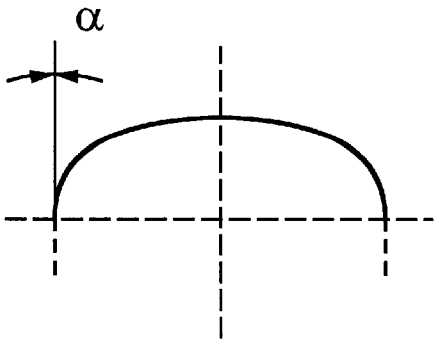
Figure 16D:
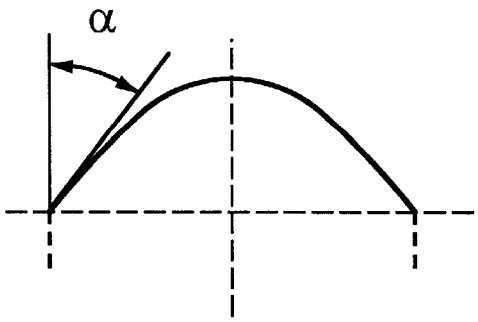
Figure 16E:
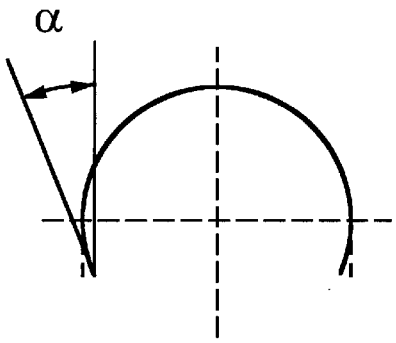
Figure 16G:
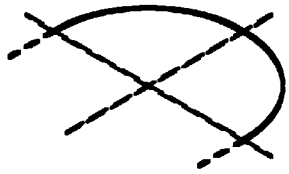
Figure 16H:
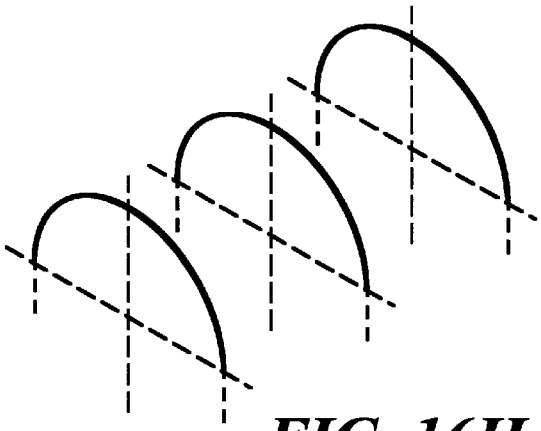
Figure 16F:
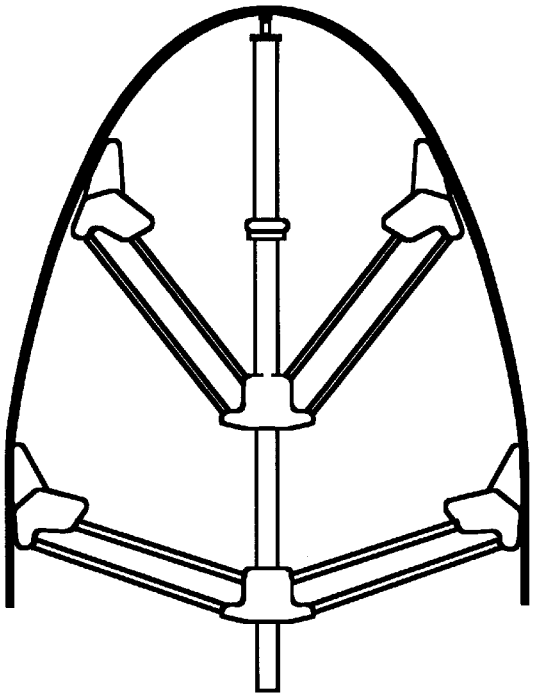
Figure 16I:
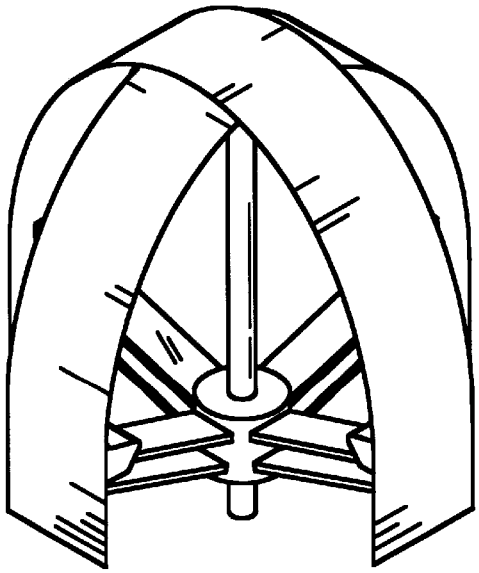

Finally, FIGS. 16A–I schematically illustrate the various types of arches which can be constructed with arch-forming assemblies of the invention. FIG. 16A shows a semi-circular arch with terminal angles α=0 degrees. FIG. 16B depicts a pointed arch with terminal angles α=0 degrees. The arch in FIG. 16C has an elliptical shape and its terminal angles α are also equal to 0 degrees. FIG. 16D is an arch segment with terminal arch angles α>0 degrees. FIG. 16E shows an arch with negative terminal angles α<0 degrees. FIG. 16F shows an embodiment having two separate sets of cross beams mounted on the same center pole for the purpose of creating dome arches. The isometric schematic views of FIGS. 16G–H show how the arch forming assembly can be used to create arches on floors or how a number of assemblies can aid in the consturction of tunnels and through-ways. Finally, FIG. 16I shows an embodiment of the present assembly for forming domes. This assembly has two sets of two cross beams set at right angles for supporting two flexible sheets. The cross beams are held in a single central slider mounted on the center pole. Alternatively, all four cross beams can have independent sliding elements to permit the user their independent adjustment for building complex and irregular domes.

The arches in FIGS. 16A and C can be made using a single flexible sheet. In contrast, the arches shown in FIGS. 16B and D are made using two or more sheet sections.

It will be clear to one skilled in the art that the above embodiment may be altered in many ways without departing from the scope of the invention. Accordingly, the scope of the invention should be determined by the following claims and their legal equivalents.

What is claimed is:

1. An arch-forming assembly having a flexible sheet for placing construction materials thereon for building an arch, said arch-forming assembly comprising:

a) a center pole having a vertex support for upholding said flexible sheet at an internal vertex of said arch;

b) two cross beams having a proximal end and a distal end, said cross beams being mounted on opposite sides of said center pole by said proximal end and carrying at said distal end an arch end support mechanism for holding said flexible sheet;

c) at least one sliding member mounted on said center pole, for slidably attaching said two adjustable cross beams to said center pole; and d) two auxiliary support arms for adjusting and fixing the inclination of said two cross beams with respect to said center pole and for mechanically supporting said two cross beams;

whereby said arch is defined by a curvature assumed by said flexible sheet between said vertex support and said arch end support mechanism of each of said two cross beams.

2. The arch-forming assembly of claim 1 further comprising a means for adjusting the position of said arch end support mechanism.

3. The arch-forming assembly of claim 1, wherein said two cross beams have a predetermined range of inclinations and said arch-forming assembly further comprises a means for forcing said arch end support mechanism in at least one of said two cross beams to maintain a predetermined arch terminal angle $\alpha$ over said predetermined range of inclinations of said at least one cross beam.

4. The arch-forming assembly of claim 3, wherein said predetermined arch terminal angle $\alpha$ is substantially 0 degrees with respect to said center pole.

5. The arch-forming assembly of claim 3, wherein said predetermined arch terminal angle $\alpha$ is adjustable from 0 to 75 degrees with respect to said center pole.

6. The arch-forming assembly of claim 3, wherein said predetermined arch terminal angle $\alpha$ is adjustable from 0 to −75 degrees with respect to said center pole.

7. The arch-forming assembly of claim 1, wherein said flexible sheet comprises a single sheet section.

8. The arch-forming assembly of claim 1, wherein said flexible sheet comprises at least two sheet sections.

9. The arch-forming assembly of claim 8 wherein said at least two sheet sections are joined at junctions and at least one of said junctions is positioned at said internal vertex.

10. The arch-forming assembly of claim 9 wherein said junction positioned at said internal vertex comprises a hinge.

11. The arch-forming assembly of claim 1, wherein said at least one sliding member comprises a central slider having a releasable latch.

12. The arch-forming assembly of claim 11, wherein said releasable latch comprises a spring-loaded mechanism for automatic latching around said center pole.

13. The arch-forming assembly of claim 1, wherein said vertex support comprises a fastening pin and said flexible sheet comprises a mating grip for attaching to said fastening pin.

14. The arch-forming assembly of claim 1, wherein said arch end support mechanism comprises a clamping surface and a U-shaped clasp, and said flexible sheet is held against said clamping surface by said U-shaped clasp.

15. The arch-forming assembly of claim 1, wherein said arch end support mechanism comprises a clasp for holding said flexible sheet at a predetermined arch terminal angle $\alpha$.

16. The arch-forming assembly of claim 15, wherein said arch end support mechanism comprises a peg and said clasp is a U-shaped clasp having two opposing arms each having a bore for receiving said peg.

17. The arch-forming assembly of claim 16, wherein said arch support mechanism comprises a spring-loaded catch for arresting said peg when said U-shaped clasp holds said flexible sheet.

18. The arch-forming assembly of claim 15, wherein said arch end support mechanism comprises a clamping surface and a peg, and said clasp is a U-shaped clasp having two opposing arms each having a bore for receiving said peg, said flexible sheet being held against said clamping surface by said U-shaped clasp and said end support mechanism further comprising an actuator for moving said peg with respect to said clamping surface.

19. The arch-forming assembly of claim 1, wherein said cross beams have a predetermined range of inclinations and each of said cross beams comprises a upper strut and a lower strut pivoted such that said upper strut and said lower strut remain parallel over said predetermined range of inclinations.

20. The arch-forming assembly of claim 19, wherein said at least one sliding member comprises a central slider and said upper strut and said lower strut are connected at said distal end by a connecting element and said arch end support mechanism is mounted on said connecting element.

21. The arch-forming assembly of claim 20, wherein said central slider has an upper pivot joint for attaching said upper strut and a lower pivot joint for attaching said lower strut, and at least one of said pivot joints is adjustable.

22. The arch-forming assembly of claim 1, wherein said arch end support mechanism comprises a swivelable clamp for holding said flexible sheet at a predetermined arch terminal angle $\alpha$.

23. The arch-forming assembly of claim 1, wherein said two auxiliary support arms comprise markings for setting the inclinations of said cross beams with respect to said center pole.

24. The arch-forming assembly of claim 1, wherein said two auxiliary support arms comprise locking means for fixing the inclinations of said cross beams with respect to said center pole.

25. The arch-forming assembly of claim 1, wherein said two auxiliary support arms are arcuate and are swivelably attached to said center pole.

26. The arch-forming assembly of claim 25, wherein each said arch end support mechanism comprises a releasable locking mechanism for guiding one of said two auxiliary support arms and anchoring said one auxiliary support arm such that the inclination of said cross beams is fixed.

27. The arch-forming assembly of claim 26, wherein said releasable locking mechanism comprises a spring-loaded bolt and said two auxiliary support arms have holes for engaging said spring loaded bolt at predetermined inclinations of said cross beams.

28. The arch-forming assembly of claim 27, wherein said two auxiliary support arms comprise a set hole such that when said spring-loaded bolt is engaged in said set hole said cross beams are approximately parallel to said center pole.

29. The arch-forming assembly of claim 1, further comprising a bar extending parallel to said center pole and having a head portion and a foot portion, said foot portion being attached to said at least one sliding member and said head portion being slidably attached to said center pole and carrying said two auxiliary support arms, said arch-forming assembly further comprising a stationary ruler extending parallel to said bar and having adjustment markings for setting the position of said bar along said center pole for adjusting the shape of said curvature and the span of said arch.

30. The arch-forming assembly of claim 29, wherein said bar comprises at least one scale and said stationary ruler further comprises at least one stationary indicator and at least one slidable indicator cooperating with said at least one scale.

31. The arch-forming assembly of claim 1, wherein said flexible sheet comprises arch span markings.

32. The arch-forming assembly of claim 1, wherein said two cross beams are telescopic and are mounted in said at least one sliding member to extend and retract in a direction substantially perpendicular to said center pole.

33. The arch-forming assembly of claim 1, wherein said two cross beams are telescopic and are mounted in said at least one sliding member to extend and retract in a direction at a predetermined slope with respect to said center pole, said two cross beams being connected by a brace perpendicular to said center pole.

34. The arch-forming assembly of claim 1, wherein said two cross beams comprise a scissors-type strut assembly for extending and retracting in a direction substantially perpendicular to said center pole.

* * * * *